United States Patent [19]

Mazis

[11] Patent Number: 4,504,891

[45] Date of Patent: Mar. 12, 1985

[54] FLUORESCENT LAMP SYSTEM

[75] Inventor: Bernard Mazis, Philadelphia, Pa.

[73] Assignee: Keystone Lighting Corporation, Bristol, Pa.

[21] Appl. No.: 570,954

[22] Filed: Jan. 16, 1984

[51] Int. Cl.[3] ..... F21S 3/00

[52] U.S. Cl. ..... 362/219; 362/221; 362/225; 362/260; 362/365; 362/368; 315/DIG. 1; 313/323

[58] Field of Search ..... 362/217, 219, 221, 222, 362/223, 224, 225, 260, 365, 368; 313/323; 315/DIG. 1, DIG. 5; 307/157

[56] References Cited

U.S. PATENT DOCUMENTS

| | | |
|---|---|---|
| 2,821,800 | 2/1958 | Hardesty. |
| 2,838,865 | 6/1958 | Hardesty. |
| 2,847,560 | 8/1958 | Peak et al. |
| 2,855,709 | 10/1958 | Roper. |
| 2,923,860 | 2/1960 | Miller. |
| 2,948,073 | 8/1960 | Roper. |
| 2,953,769 | 9/1960 | Woofter et al. |
| 3,015,718 | 1/1962 | Petri. |
| 3,065,335 | 11/1962 | Madansky. |
| 3,077,535 | 2/1964 | Dufree. |
| 3,120,350 | 2/1964 | Muenz. |
| 3,344,388 | 9/1967 | Parker et al. |
| 3,366,914 | 1/1968 | McManus, et al. |
| 3,480,836 | 11/1969 | Aronstein. |
| 3,514,590 | 5/1970 | Shaffer ..... 362/221 |
| 3,544,950 | 12/1970 | Lopez et al. |
| 4,130,860 | 12/1978 | Careglio et al. |
| 4,246,632 | 1/1981 | Hancox. |
| 4,309,745 | 1/1982 | Zalina. |
| 4,429,348 | 1/1984 | Dean. |

*Primary Examiner*—Donald P. Walsh
*Attorney, Agent, or Firm*—Walter B. Udell

[57] ABSTRACT

A fluorescent lamp system including a pair of fluorescent lamp socket bars, a pair of ballast transformers, and a wiring harness. Each lamp socket bar consists of a sandwich of a molded plastic plate which holds the lamp socket contacts and the wiring connector pins, and a printed circuit wiring plate which makes electrical contact with the socket contacts and connector pins through mechanical pressure contact, and which wiring plate contains the circuit wiring excepting for the interconnections with the ballast transformers, such interconnections being effected either by means of a wiring harness having plug connectors which pluggingly connect to pins on the lamp socket bar and to the ballast transformers or by quick-wire connections from the ballast transformers themselves. If a cable harness is used, the ballasts are also pluggably engageable with the fluorescent lamp socket bars. Assembly of a working fluorescent lamp troffer structure is drastically simplified and accomplished rapidly by securing two of the lamp socket bars within the troffer, plugging the ballast transformers into the socket bar and securing the transformers mechanically to the troffer, and plugging the cable harness into the ballast transformers and lamp socket bars, or alternatively, by quick-wiring the ballasts to the socket bars.

21 Claims, 13 Drawing Figures

FIG. 1
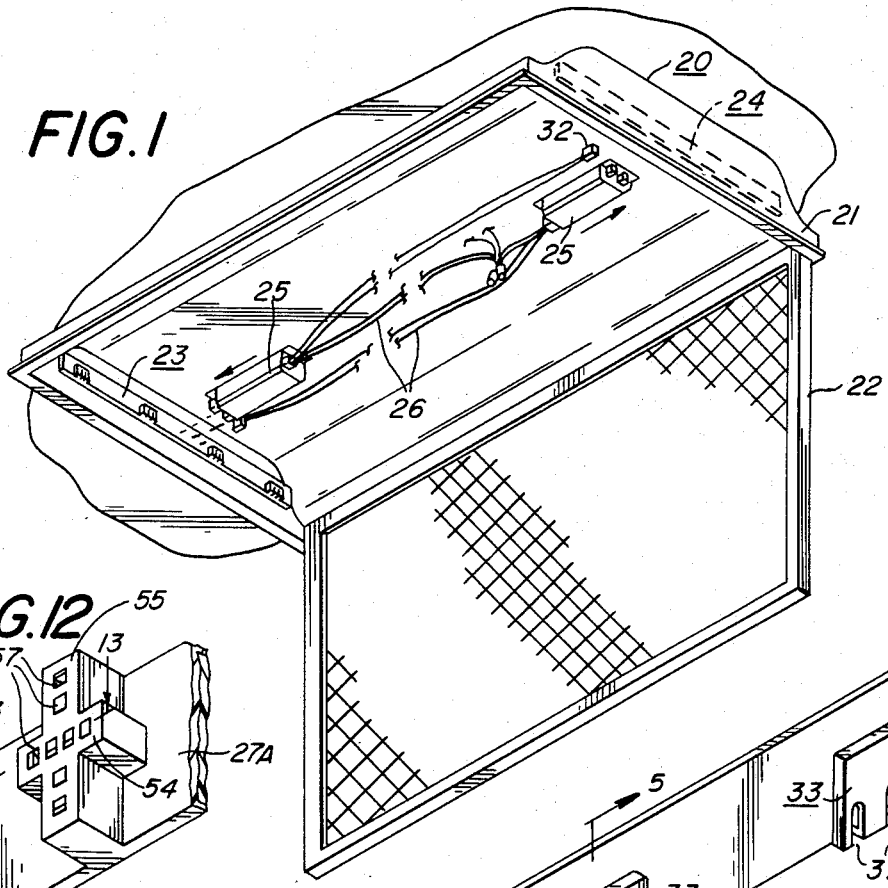
FIG. 12
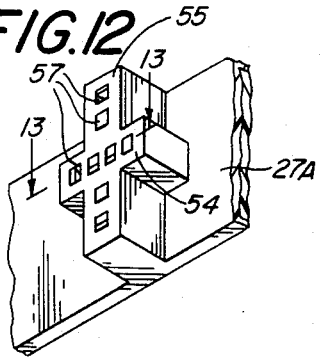
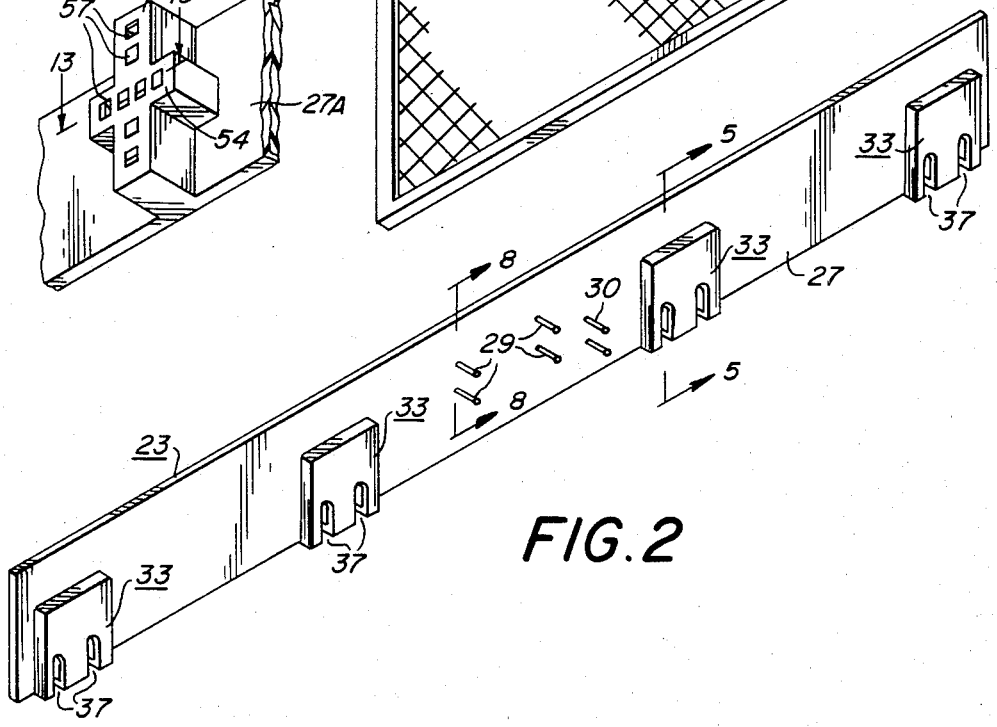
FIG. 2

FIG. 5
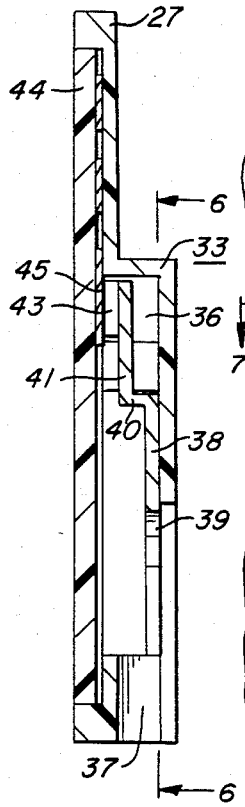
FIG. 6
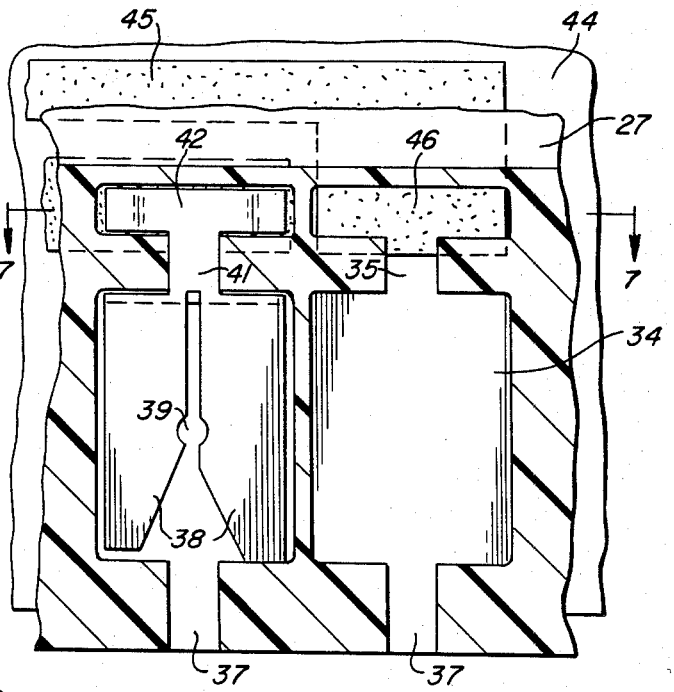
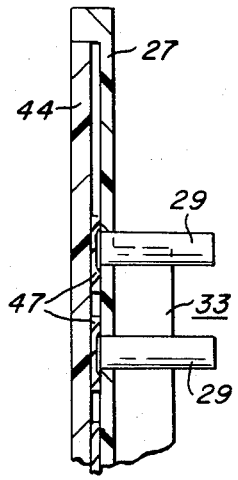
FIG. 8
FIG. 7
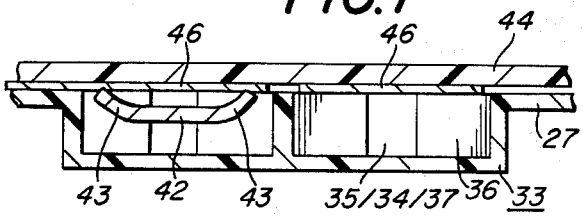

FLUORESCENT LAMP SYSTEM

This invention relates generally to fluorescent lamp systems, and more particularly relates to an integrated socket, wiring, and cabling system for use in connection with such systems.

The present method of manufacturing fluorescent lamp systems, as for example a four lamp troffer, requires the assembling of a substantial number of individual parts which are then wired together by discrete wiring runs and then all mounted inside the mechanical housing for the lamp system. In a four lamp system, there are for example two separate four socket arrays, one installed at each end of the troffer, and each typically consisting of a mounting bracket to which are secured four individual lamp sockets each of which has two or four wires extending from it. Each of the lamp sockets is itself an assembly which usually consists of a main body carrying a pair of individual contacts and a backing or closure member for the socket which retains the contacts within the body, the contacts each being connected to a discrete electrical wire lead which extends outward from the body of the socket. In addition, the assembly includes a pair of ballast transformers with their own wires, and the wires of all of these various components must be interconnected by means of wire nuts, solder connections, or quick-wire connections.

Substantial components costs and labor assembly costs are involved in fabricating a troffer of this construction. The lamp system according to the invention substantially reduces both the component cost and the assembly labor cost for such a fluorescent lamp structure by substituting for the previously described individually wired lamp socket assemblies a pair of fluorescent lamp socket bars. Each lamp socket bar is basically a sandwich of a molded plastic plate which holds the lamp socket contacts and the wiring connector pins, and a printed circuit wiring plate which makes electrical contact with the socket contacts and connector pins through mechanical pressure contact, and which contains the circuit wiring excepting for the interconnections with the ballast transformers, such interconnections being effected either by means of a cable harness having plug connectors which pluggingly connect to pins on the lamp socket bar and to the ballast transformers or by quick-wire connections from the ballast transformers themselves. If a cable harness is used, the ballasts are also pluggably engageable with the fluorescent lamp socket bars.

Assembly of a working fluorescent troffer structure is consequently drastically simplified and accomplished rapidly by merely securing two of the lamp socket bars within the troffer, plugging the ballast transformers into the socket bar and securing the transformers mechanically to the troffer, and plugging the preformed cable harness into the ballast transformers and lamp socket bars, or alternatively, by quick-wiring the ballasts to the socket bars.

It is a primary object of the invention to provide a novel fluorescent lamp system which utilizes a novel fluorescent lamp socket bar and ballast transformers which are either quick-wired together or are pluggably engaged with each other and with a cabling harness having plugs interconnected with the novel lamp socket bar and the ballast transformers.

Another object of the invention is to provide a novel fluorescent lamp system as aforesaid in which the novel fluorescent socket bar comprises a sandwich of a molded plastic plate which holds the lamp socket contacts and the wiring connector pins, and a printed circuit wiring plate which contains the circuit wiring and which makes electrical contact with the socket and connector pins through mechanical pressure contact when the two plates are mechanically intersecured.

A further object of the invention is to provide a novel fluorescent lamp system including a novel fluorescent lamp socket bar as aforesaid in which the printed circuit wiring could also be on the molded plastic plate which holds the lamp socket contacts and the connector pins.

Still a further object of the invention is to provide a novel fluorescent lamp system as aforesaid which utilizes multiple fluorescent lamps and includes mutiple ballast transformers.

The foregoing and other objects of the invention will become clear from a reading of the following specification in conjunction with an examination of the appended drawings, wherein:

FIG. 1 is an isometric view from below of a four lamp fluorescent troffer in which the bottom diffuser grill or lens is hinged downward to disclose the interior of the lamp system;

FIG. 2 is an isometric view of a fluorescent lamp socket bar according to the invention as would be seen from the front or working face of the lamp socket bar;

FIG. 5 is a vertical section on an enlarged scale through the novel lamp socket bar as would be seen when viewed along the line 5—5 on FIG. 2;

FIG. 6 is a vertical sectional view through the lamp socket bar according to the invention as would be seen when viewed along the lines 6—6 of FIG. 5;

FIG. 7 is a horizontal cross-section looking downward through the lamp socket bar and contact as would be seen when viewed along the line 7—7 of FIG. 6;

FIG. 8 is a fragmentary enlarged vertical sectional view through a pair of the pin connectors as would be seen when viewed along the line 8—8 on FIG. 2;

FIG. 12 shows an alternative wiring connector to the connector pins shown in FIGS. 2, 3 and 11.

In the several figures, like elements are denoted by like reference characters.

Figures 3, 4, 13:
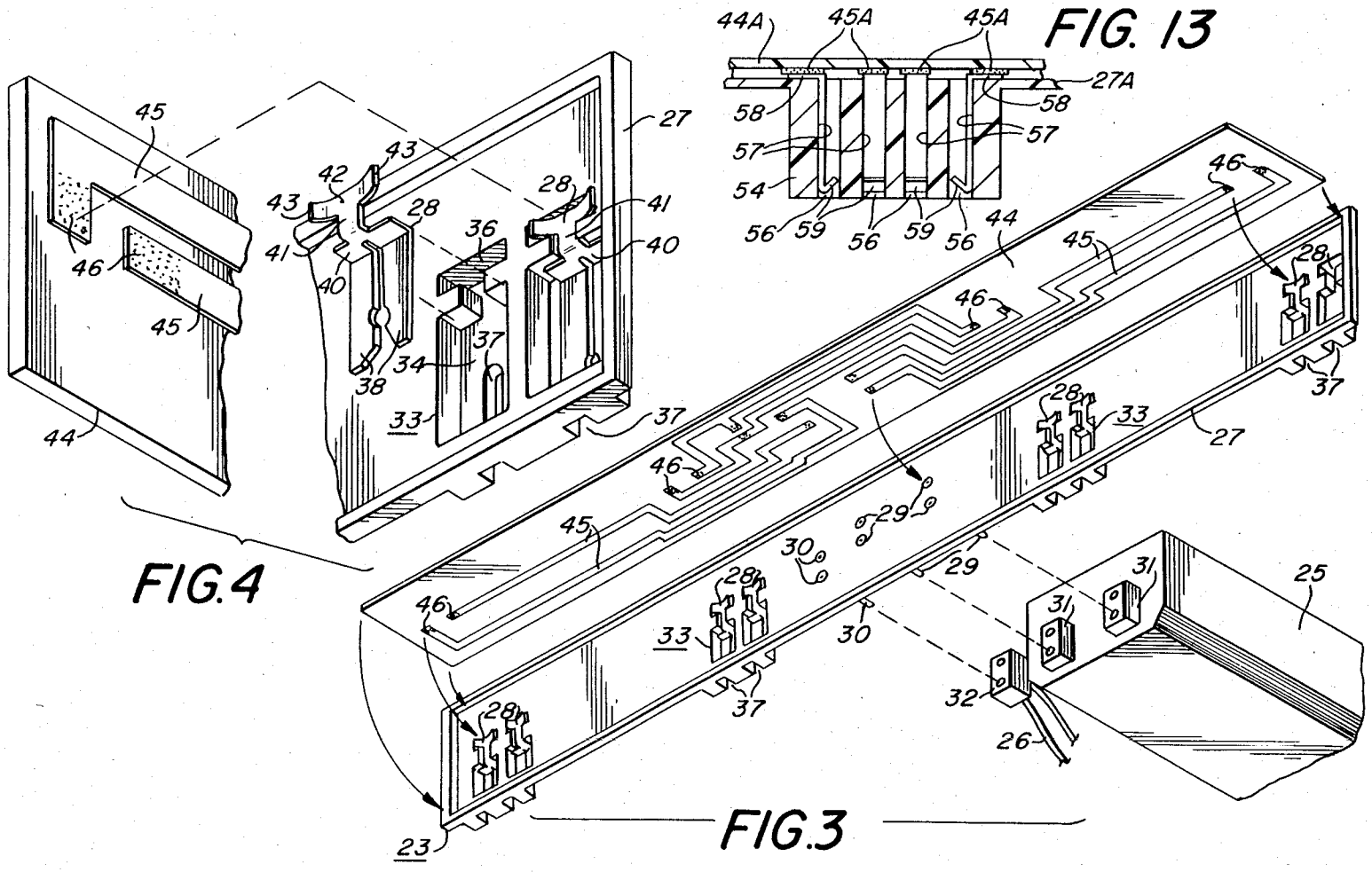
FIG. 3 is an isometric view of the lamp socket bar as shown in FIG. 2, but as viewed from the rear with the printed circuit wiring plate separated and pivoted up at 90° to the rear of the socket contacts and pins holding plate.
FIG. 4 is an enlarged fragmentary view of the right-hand end of the lamp socket bar shown in FIG. 3 illustrating in clearer detail the structure of the socket contacts and sockets, together with the contacts thereto from the printed circuit plate.
FIG. 13 is an enlarged sectional view through the alternative wiring connector shown in FIG. 12 as would be seen when viewed along the lines 13—13 on FIG. 12.

Referring now to the drawings and firstly to FIG. 1 there is seen a fluorescent lamp troffer denoted generally as 20 having a housing 21 within which are housed the electrical system and the fluorescent lamps, and the bottom of which housing is closed by an openable and latchable diffuser panel 22. Secured within the opposite ends of the housing 21 to the end walls are the novel lamp socket bars according to the invention which are designated as 23 and 24, a pair of identical ballast transformers 25, and a preformed and plug terminated wiring harness 26. As best seen in FIGS. 2 and 3, the lamp socket bar 23 includes the molded plastic plate 27 which holds the socket contacts 28, the ballast connecting pins 29 and the wiring harness connecting pins 30 which are respectively connectable to the ballast transformers 25 by means of the plugs 31 and to the wiring harness 26 by means of the plug 32.

Each of the socket pins 28 is disposed in a molded cavity 33 best seen in FIGS. 4 and 6, and which includes a main rectangular cavity 34 surmounted by a T shaped region having a stem 35 extending vertically upward from the center of the top of the main rectangular cavity 34 and terminating in a horizontal stroke region 36 of substantially the same width as the main rectangular cavity 34. Opening downward from the center of the main rectangular cavity 34 and opening through the bottom of the cavity 33 is a slotted opening 37 upwardly through which a pin of a fluorescent tube is projectable into engagement with the lead-in edges of the pin-engaging legs 38 of the socket contacts 28, the fluorescent tube contact pins being projectable upward to spring apart the legs 38 so that the pin may be captured in the circular detent 39 formed between the legs 38 to hold the fluorescent tube securely within the sockets.

The legs 38 of the socket contacts 28 are joined together at their upper ends by a horizontally offset yoke portion 40 surmounted by a vertically turned stem portion 41 which latter passes upward through the region 35 of the socket pin cavity and terminates in a horizontal arm 42 disposed within the horizontal cavity portion 36 of the socket contact cavity 33, the contact arm 42 having its terminal ends 43 turned rearward for a sufficient distance to project out of the cavity 36 when the printed circuit wiring plate 44 is not in position closing the back of the molded plastic plate 27.

Figure 10:
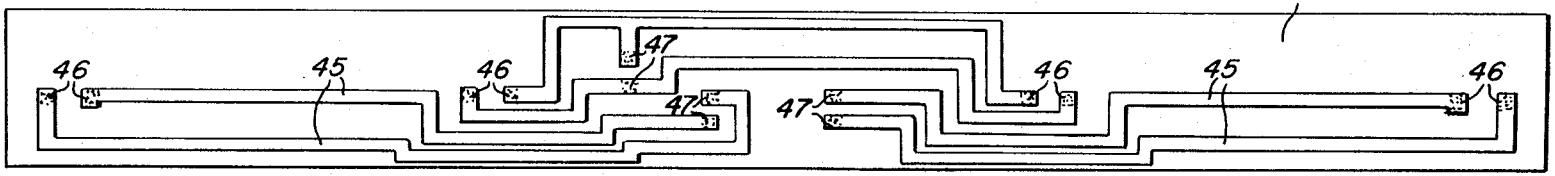

As best seen in FIGS. 3 and 10, the printed circuit wiring plate 44 is provided with a conductive wiring pattern made up of various conductive strips 45 layed down upon the non-conductive surface of the plate 44 in any convenient manner, as is well known in the art. As best seen from FIGS. 4, 5 and 7, when the wiring plate 44 is placed in position against the back of the molded plate 27, appropriate ones of the conductive strips 45 are pressed firmly against the terminal ends 43 of the socket contacts 28 to make electrical contact therewith in order to energize appropriately the socket contacts 28 to activate the fluorescent lamps when they are installed with their pins engaged with the socket contacts 28. The regions of the conductive strips 45 on the wiring plate 44 which contact the socket contacts 28 are shown as 46.

Similarly, as best seen in FIGS. 3, 8 and 10, the rear contact faces of the ballast contact pins 29 and wiring harness pins 30 are brought into electrical engagement with others of the conductive strips 45 when the wiring plate 44 is placed in position, these contact regions being designated as 47. The wiring plate 44 may be mechanically secured to the molded plastic plate 27 in any convenient fashion, as for example by means of adhesives or by thru-fasteners which secure the two parts together in regions where there is no electrical circuitry involved.

Figure 9:
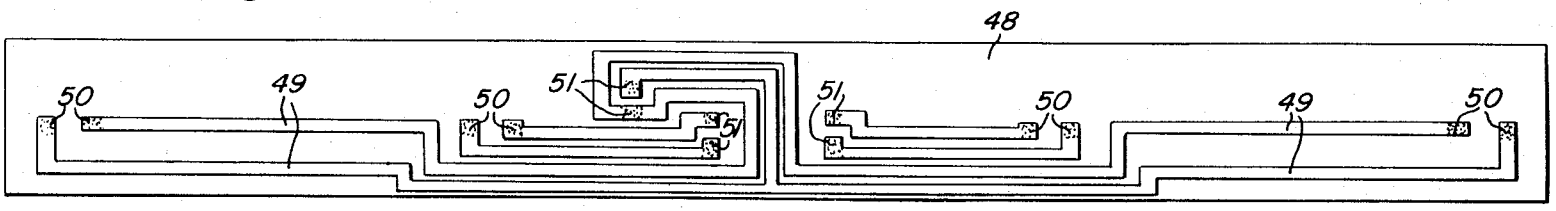
FIGS. 9 and 10 show two different printed circuit wiring plates used with the same type of socket plate to form two different lamp sockets bars, both of which are utilized in the system.
Figure 11:
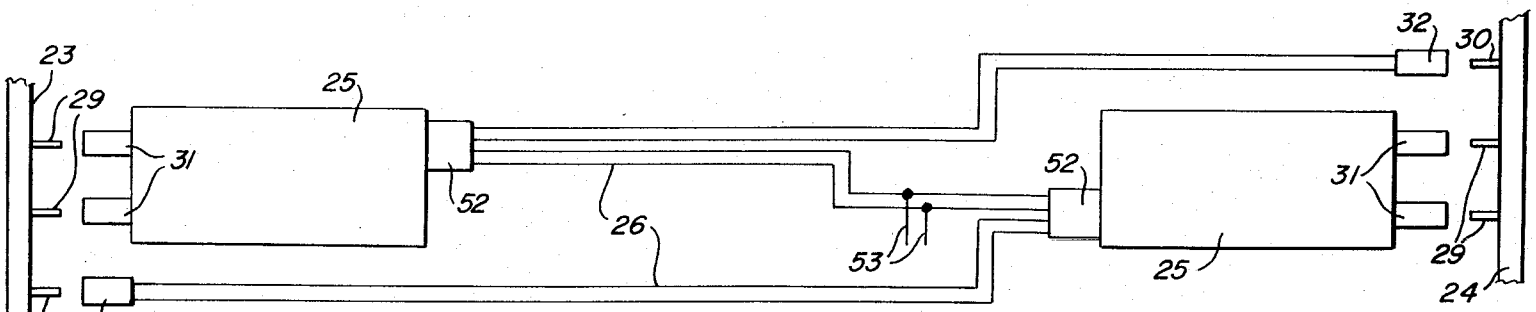
FIG. 11 is a schematic view showing the plugging interconnections amongst the lamp socket bars, the ballast transformers and the preformed wiring harness.

The wiring plate 48 shown in FIG. 9 serves the same function as the wiring plate 44 but in connection with the lamp socket bar 24 which is disposed at the opposite end of the housing from the socket bar 23 which has just been described in detail. As would be expected, the conductive strips 49 serve the same function as the conductive strips 45 of wiring plate 44 but are arranged in a different pattern as dictated by the necessity of the electrical circuit requirements. There are socket contact points 50 and contact pins contact points 51 which correspond respectively to the contact points 46 and 47 on wiring plate 44. As best seen in FIG. 11 the wiring harness 26 is completed by the two plugs 52 which plug into the ballast transformers 25, and by the AC connections 53 which provide a means of connection to a source of energizing power for the fluorescent fixture.

While not normally as convenient or economical, it is possible to place the conductive strips 45 and 49 on the plate 27 instead of on the wiring plates 44 and 48, in which event the latter would function to secure the assembly together and maintain pressure contact between the conductive strips and the socket contacts 28 and connector pins 29.

If it is desired to employ quick-wiring instead of the plug system previously described, quick-wiring contacts can be structurally integrated with the molded plastic plate as shown in FIGS. 12 and 13 in which there is seen a modified molded plate 27A having integrally molded onto the front face a cruciform projection having a horizontal arm 54 and a vertical arm 55, with thru-holes 56 passing completely from front to back. Projected into each hole 56 from the rear face of the plate 27A is a quick-wiring contact pin 57 having a tail 58 turned at right angles to the length of the contact pin, the tail being of sufficient length to prevent the contact pin from slipping through the hole. As with the contact pins 29 and 30, the contact pins 57 are retained in position in electrical circuit contact by means of the printed circuit wiring plate 44A which carries the conductive strips 45A. The system is wired by pushing the ballast transformer leads into the thru-holes 56 where they are electrically and mechanically engaged by the spring ends 59 of the contact pins 57.

Having now described the invention in connection with a particularly illustrated embodiment thereof, there will now naturally occur from time to time to those persons normally skilled in the art variations and modifications of the invention without departing from the essential spirit and scope of the invention, and accordingly it is intended to claim the same broadly as well as specifically as indicated by the appended claims.

I claim:

1. A pair of first and second lamp socket bars for a fluorescent lamp system, each said bar comprising in combination, (a) an elongated plate of insulating material carrying a plurality of contact receiving cavities for holding in operative position electrical contacts suitable for energizing a plurality of fluorescent lamps, (b) an electrical contact operatively disposed in each of said plurality of contact receiving cavities, (c) a second elongated plate of insulating material secured against one face of said elongated plate of insulating material and mechanically pressing against some part of each of said electrical contacts, (d) an arrangement of electrical conductors fixed upon that surface of at least one of said elongated plate and second elongated plate of insulating material which faces the other, particular points of said arrangement of electrical conductors being positioned to make contact with said electrical contacts disposed in said plurality of contact receiving cavities, the said arrangement of electrical conductors in said first and second lamp socket bars including all of the circuit wiring for a complete fluorescent lamp system except for the wiring to any necessary ballast transformers, and (e) connector means carried by one of said elongated plate and second elongated plate of insulating material, said connector means being connected to said arrangement of electrical conductors effective for connecting the latter to any necessary ballast transformers external to said pair of first and second lamp socket bars.

2. A lamp socket bar as described in claim 1 wherein said arrangement of electrical conductors is fixed upon the surface of said second elongated plate of insulating material.

3. A lamp socket bar as described in claim 1 wherein said elongated plate of insulating material is plastic and said contact receiving cavities are integral therewith.

4. A lamp socket bar as described in claim 1 wherein said connector means comprises a plurality of contact pins carried by and extending from said elongated plate of insulating material.

5. A lamp socket bar as described in claim 1 wherein said contact means comprises a plurality of connector pins carried by and extending from said elongated plate of insulating material, and said arrangement of electrical conductors is fixed upon the surface of said second elongated plate of insulating material.

6. A lamp socket bar as described in claim 1 wherein said elongated plate of insulating material is plastic and said contact receiving cavities are integral therewith, and wherein said connector means comprises a plurality of contact pins carried by and extending from said elongated plate of insulating material.

7. A lamp socket bar as described in claim 1 wherein said elongated plate of insulating material is plastic and said contact receiving cavities are integral therewith, and wherein said arrangement of electrical conductors is fixed upon the surface of said second elongated plate of insulating material.

8. A lamp socket bar as described in claim 1 wherein said elongated plate of insulating material is plastic and said contact receiving cavities are integral therewith, wherein said connector means comprises a plurality of contact pins carried by and extending from said elongated plate of insulating material, and wherein said arrangement of electrical conductors is fixed upon the surface of said second elongated plate of insulating material.

9. A fluorescent lamp system comprising in combination, first and second lamp socket bars adapted to be secured in spaced relation so that the contact pins at the opposite ends of a plurality of fluorescent lamps can be respectively engaged therewith, ballast transformer means, and wiring means interconnecting said first and second lamp socket bars and said ballast transformer means, said first and second lamp socket bars together including all of the circuit wiring for a complete fluorescent lamp system except for the aforesaid wiring means interconnecting said first and second lamp socket bars and said ballast transformer means, each of said first and second lamp socket bars comprising in combination, (a) an elongated plate of insulating material carrying a plurality of contact receiving cavities for holding in operative position electrical contacts suitable for energizing a plurality of fluorescent lamps, (b) an electrical contact operatively disposed in each of said plurality of contact receiving cavities, (c) a second elongated plate of insulating material secured against one face of said elongated plate of insulating material and mechanically pressing against some part of each of said electrical contacts, (d) an arrangement of electrical conductors fixed upon that surface of at least one of said elongated plate and second elongated plate of insulating material which faces the other, particular points of said arrangement of electrical conductors being positioned to make contact with said electrical contacts disposed in said plurality of contact receiving cavities, and (e) connector means carried by one of said elongated plate and second elongated plate of insulating material, said connector means being connected to said arrangement of electrical conductors effective for connecting the latter to said wiring means.

10. A fluorescent lamp system as described in claim 9 wherein the said arrangement of electrical conductors in said first lamp socket bar is different from the said arrangement of electrical conductors in said second lamp socket bar.

11. A fluorescent lamp system as described in claim 9 wherein said connector means of each of said first and second lamp socket bars comprises a plurality of contact pins carried by and extending from said elongated plate of insulating material.

12. A fluorescent lamp system as described in claim 9 wherein said arrangement of electrical conductors in each of said first and second lamp socket bars is fixed upon the surface of said second elongated plate of insulating material of each.

13. A fluorescent lamp system as described in claim 9 wherein said connector means of each of said first and second lamp socket bars comprises a plurality of contact pins carried by and extending from said elongated plate of insulating material, and wherein each of said ballast transformer means and said wiring means comprises additional connector means which are quick detachably connectable to particular ones of said plurality of contact pins carried by each of said first and second lamp socket bars.

14. A fluorescent lamp system as described in claim 9 wherein in each of said first and second lamp socket bars said elongated plate of insulating material is plastic and said contact receiving cavities are integral therewith, wherein said connector means comprises a plurality of contact pins carried by and extending from said elongated plate of insulating material, and wherein said arrangement of electrical conductors is fixed upon the surface of said second elongated plate of insulating material.

15. A fluorescent lamp system as described in claim 13 wherein in each of said first and second lamp socket bars said elongated plate of insulating material is plastic and said contact receiving cavities are integral therewith, and wherein said contact means comprises a plurality of contact pins carried by and extending from said elongated plate of insulating material.

16. A fluorescent lamp system as described in claim 13 wherein in each of said first and second lamp socket bars said elongated plate of insulating material is plastic and said contact receiving cavities are integral therewith, and wherein said arrangement of electrical conductors is fixed upon the surface of said second elongated plate of insulating material.

17. A fluorescent lamp system as described in claim 13 wherein in each of said first and second lamp socket bars said contact means comprises a plurality of contact pins carried by and extending from said elongated plate of insulating material, and said arrangement of electrical conductors is fixed upon the surface of said second elongated plate of insulating material.

18. A fluorescent lamp system as described in claim 13 wherein the said arrangement of electrical conductors in said first lamp socket bar is different from the said arrangement of electrical conductors in said second lamp socket bar.

19. A fluorescent lamp system as described in claim 18 wherein in each of said first and second lamp socket bars said elongated plate of insulating material is plastic and said contact receiving cavities are integral therewith, wherein said connector means comprises a plurality of contact pins carried by and extending from said elongated plate of insulating material, and wherein said arrangement of electrical conductors is fixed upon the surface of said elongated plate of insulating material.

20. A fluorescent lamp system comprising in combination, first and second two piece molded plastic lamp socket bars adapted to be secured in spaced relation so that the contact pins at the opposite ends of four fluorescent lamps can be respectively engaged therewith, ballast transformer means, and wiring means interconnecting said first and second lamp socket bars and said ballast transformer means, the said two pieces of each of said first and second molded plastic lamp socket bars having electrical conductors sandwiched therebetween and together including all of the circuit wiring for a complete four lamp fluorescent lamp system except for the aforesaid wiring means interconnecting said first and second lamp socket bars and said ballast transformer means.

21. A fluorescent lamp system comprising in combination, first and second two piece molded plastic lamp socket bars adapted to be secured in spaced relation so that the contact pins at the opposite ends of a plurality of fluorescent lamps can be respectively engaged therewith, ballast transformer means, and wiring means interconnecting said first and second lamp socket bars and said ballast transformer means, the said two pieces of each of said first and second molded plastic lamp socket bars having electrical conductors sandwiched therebetween and together including all of the circuit wiring for a complete plural lamp fluorescent lamp system except for the aforesaid wiring means interconnecting said first and second lamp socket bars and said ballast transformer means.

* * * * *